US005425663A

United States Patent [19]

Meisenburg et al.

[11] Patent Number: 5,425,663

[45] Date of Patent: Jun. 20, 1995

[54] COUNTER-ROTATING SURFACING MARINE DRIVE WITH PLANING PLATE

[75] Inventors: Gary L. Meisenburg; Phillip D. Magee; John W. Behara, all of Stillwater, Okla.

[73] Assignee: Brunswick Corporation, Lake Forest, Ill.

[21] Appl. No.: 84,346

[22] Filed: Jun. 28, 1993

Related U.S. Application Data

[63] Continuation-in-part of Ser. No. 889,495, May 27, 1992, Pat. No. 5,230,644, and Ser. No. 889,530, May 27, 1992, Pat. No. 5,249,995.

[51] Int. Cl.[6] ..... B63H 5/10

[52] U.S. Cl. ..... 440/80; 440/76

[58] Field of Search ..... 440/53, 57, 66, 79–81, 440/83, 76, 78, 900; 114/274, 285

[56] References Cited

U.S. PATENT DOCUMENTS

| | | | |
|---|---|---|---|
| 2,860,594 | 11/1958 | Kiekhaefer | 440/78 |
| 3,952,686 | 4/1976 | Pickl | 115/17 |
| 4,205,618 | 6/1980 | Olsson | 440/66 |
| 4,630,719 | 12/1986 | McCormick | 192/21 |
| 4,679,682 | 7/1987 | Gray, Jr. et al. | 192/21 |
| 4,764,135 | 8/1988 | McCormick | 440/83 |
| 4,781,632 | 11/1988 | Litjeus et al. | 440/78 |
| 4,790,782 | 12/1988 | McCormick | 440/61 |
| 4,792,315 | 12/1988 | Karrasch et al. | 440/83 |
| 4,795,382 | 1/1989 | McCormick | 440/81 |
| 4,832,635 | 5/1989 | McCormick | 440/78 |
| 4,832,636 | 5/1989 | McCormick | 440/80 |
| 4,863,406 | 9/1989 | Bland et al. | 440/83 |
| 4,869,121 | 9/1989 | Meisenburg | 74/323 |
| 4,869,694 | 9/1989 | McCormick | 440/83 |
| 4,871,334 | 10/1989 | McCormick | 440/89 |
| 4,897,058 | 1/1990 | McCormick | 440/80 |
| 4,900,281 | 2/1990 | McCormick | 440/78 |
| 4,993,848 | 2/1991 | John et al. | 384/97 |
| 5,203,275 | 4/1993 | Brauner et al. | 114/274 |
| 5,234,362 | 8/1993 | Breckeufeld et al. | 440/78 |

*Primary Examiner*—Edwin L. Swinehart

*Attorney, Agent, or Firm*—Andrus, Sceales, Starke & Sawall

[57] ABSTRACT

A marine drive (10) has two counter-rotating surface operating propellers (12 and 14). A planing plate (230) extends rearwardly from the drive housing (20) above the propellers (12 and 14) and pushes down on the surface of the water during initial boat acceleration to in turn lower the bow and aid in getting the boat up on plane. Right and left inclined splash plates (240 and 242) along the sides of the housing (20) extend from the torpedo portion (188) rearwardly and upwardly at an incline and meet the planing plate (230).

9 Claims, 4 Drawing Sheets

COUNTER-ROTATING SURFACING MARINE DRIVE WITH PLANING PLATE

CROSS REFERENCE TO RELATED APPLICATIONS

This application is a continuation-in-part of allowed U.S. application Ser. No. 07/889,495, filed May 27, 1992, now U.S. Pat. No. 5,230,644, and allowed U.S. application Ser. No. 07/889,530, filed May 27, 1992, now U.S. Pat. No. 5,249,995, incorporated herein by reference.

BACKGROUND AND SUMMARY

The invention relates to a marine drive having two counter-rotating surface operating propellers.

The present invention arose during development efforts directed toward a marine drive enabling increased top end boat speed. This is achieved by raising the torpedo or gear box out of the water to reduce drag, and by using two counter-rotating surface operating propellers. Surfacing drives are known in the art, for example U.S. Pat. No. 4,871,334, column 3, lines 35+.

The present invention provides structure effective during initial boat acceleration to aid in getting the boat up on plane, i.e. from a submerged condition of the propellers to a surfacing condition of the propellers. A planing plate extends rearwardly from the drive housing and pushes down on the surface of the water during initial boat acceleration to in turn lower the bow and aid in getting the boat up on plane.

In a further aspect of the invention, the drive housing includes right and left inclined splash plates extending from the torpedo portion rearwardly and upwardly at an incline and meeting the planing plate.

DETAILED DESCRIPTION

Figure 1:
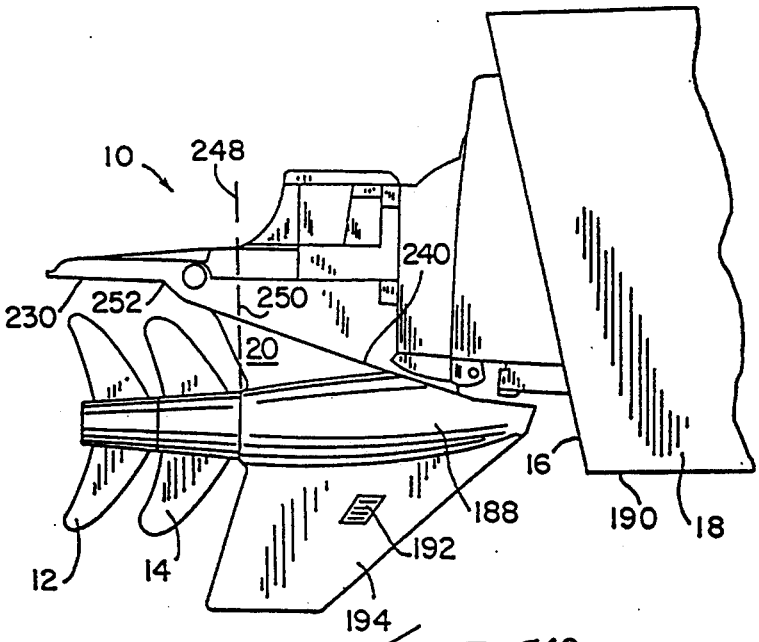
FIG. 1 is a side elevation view of a marine drive in accordance with the invention.

FIG. 1 shows a marine drive 10 having two counter-rotating surface operating propellers 12 and 14. The drive is mounted to the transom 16 of a boat 18 in the usual manner for a stern drive. The drive includes a housing 20, FIG. 2, having upper and lower spaced horizontal bores 22 and 24, and an intersecting vertical bore 26 extending therebetween. An upper input shaft 28 is in upper horizontal bore 22 and is coupled through a universal joint 30 to an input shaft 32 driven by the engine (not shown) in the boat. The universal joint enables trimming and steering of the drive. The input shaft drives an upper gear assembly 34 which is known in the art, for example as shown in U.S. Pat. Nos. 4,630,719, 4,679,682, and 4,869,121, incorporated herein by reference. A downwardly extending driveshaft 36 in vertical bore 26 is driven by input shaft 28 through upper gear assembly 34 operatively connected therebetween. Input gear 38 on shaft 28 rotates about a horizontal axis and drives gears 40 and 42 to rotate in opposite directions about a vertical axis. Shift and clutch assembly 44 causes engagement of one or the other of gears 40 and 42, to in turn cause rotation of driveshaft 36 in one or the other direction, to provide forward or reverse operation, all as in the noted incorporated patents.

Figure 3:
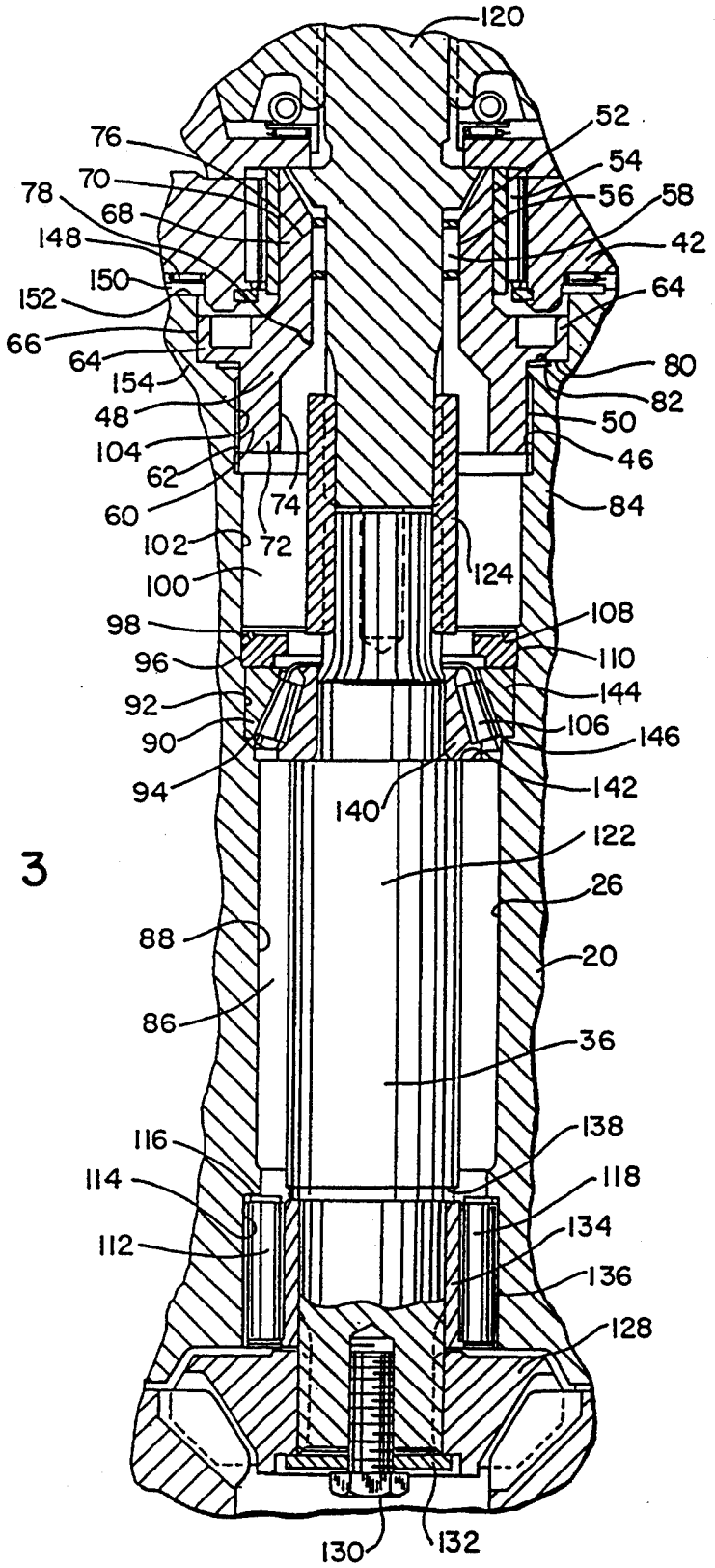
FIG. 3 is an enlarged view of a portion of the structure of FIG. 2.

Vertical bore 26 has an upper threaded portion 46, FIG. 3. An upper adaptor spool 48 has a lower threaded outer portion 50 mating with threaded portion 46 of vertical bore 26 and supporting gear 42 for rotation about driveshaft 36. Adaptor spool 48 has an upper outer surface 52 supporting an upper outer needle bearing 54 which supports gear 42 for rotation about adaptor spool 48. Adaptor spool 48 has an upper inner surface 56 supporting an upper inner needle bearing 58 which supports driveshaft 36 for rotation in adaptor spool 48.

Adaptor spool 48 has a lower outer section 60, FIG. 3, of a first outer diameter 62 and threaded as noted at 50 and mating with upper threaded portion 46 of vertical bore 26. Adaptor spool 48 has a central outer section 64 above lower outer section 60 and of a central outer diameter 66 larger than lower outer diameter 62. Adaptor spool 48 has an upper outer section 68 above central outer section 64 and of an upper outer diameter 70 less than central outer diameter 66 and less than lower outer diameter 62. Adaptor spool 48 has a lower inner section 72 of a lower inner diameter 74 within vertical bore 26. Adaptor spool 48 has an upper inner section 76 above lower inner section 72 and of an upper inner diameter 78 less than lower inner diameter 74. Upper outer needle bearing 54 is between gear 42 and upper outer section 68 of adaptor spool 48 and supports gear 42 for rotation about adaptor spool 48. Upper inner needle bearing 58 is between driveshaft 36 and upper inner section 76 of adaptor spool 48 and supports drive-shaft 36 for rotation in adaptor spool 48. Lower outer section 60 and central outer section 64 of adaptor spool 48 meet at a downwardly facing annular shoulder 80 at the top end 82 of housing sidewall 84 forming vertical bore 26. Upper outer diameter 70 is substantially equal to lower inner diameter 74 of adaptor spool 48.

Vertical bore 26 has a first section 86, FIG. 3, of a first inner diameter 88. Vertical bore 26 has a second section 90 above first section 86 and of a second inner diameter 92 larger than inner diameter 88. Sections 86 and 90 meet at an upwardly facing annular shoulder 94. Vertical bore 26 has a first thread 96 above second section 90 and of an inner diameter 98 at least as great as second inner diameter 92. Vertical bore 26 has a third section 100 above first thread 96 and of a third inner diameter 102 greater than second inner diameter 98. Vertical bore 26 has a second thread, provided by the noted thread 46, above third section 100 and of an inner diameter 104 at least as great as third inner diameter 102. A central tapered roller thrust bearing 106 is seated against shoulder 94 of vertical bore 26. An annular ring 108 has a threaded outer portion 110 mating with thread 96 of vertical bore 26 and retains bearing 106 against shoulder 94. Vertical bore 26 has a fourth section 112 below first section 86 and of a fourth inner diameter 114 larger than first inner diameter 88. First and fourth sections 86 and 112 meet at a downwardly facing annular shoulder 116. A lower needle bearing 118 is seated against downwardly facing shoulder 116 and supports driveshaft 36 for rotation. Central and upper bearings 106 and 58 are inserted into vertical bore 26 from above, FIG. 4. Lower bearing 118 is inserted into vertical bore 26 from below.

Driveshaft 36, FIG. 3, is a two piece member formed by an upper driveshaft segment 120 and a lower driveshaft segment 122 coupled by a sleeve 124 in splined relation. Central bearing 106 and lower bearing 118 support the lower driveshaft segment 122. Upper bearing 58 supports the upper driveshaft segment 120. The upper driveshaft segment is also supported by another upper needle bearing 126, FIG. 2, as in the noted incorporated patents.

Driveshaft 36 has a lower pinion gear 128, FIG. 3, mounted thereto by bolt 130 and washer 132. Needle bearing 118 is above pinion gear 128 and is supported between inner and outer races 134 and 136. Outer race 136 engages shoulder 116, and inner race 134 engages shoulder 138 on lower driveshaft segment 122. Bearing 106 has an inner race 140 engaging shoulder 142 on lower driveshaft segment 122. Bearing 106 has an outer race 144 stopped against shoulder 94 in bore 26. One or more shims 146 may be provided between outer race 144 and shoulder 94 to adjust axial positioning if desired. Gear 42 rotates on bearing 148 on race 150 seated on shoulder 152 of housing sidewall 154.

Figure 2:
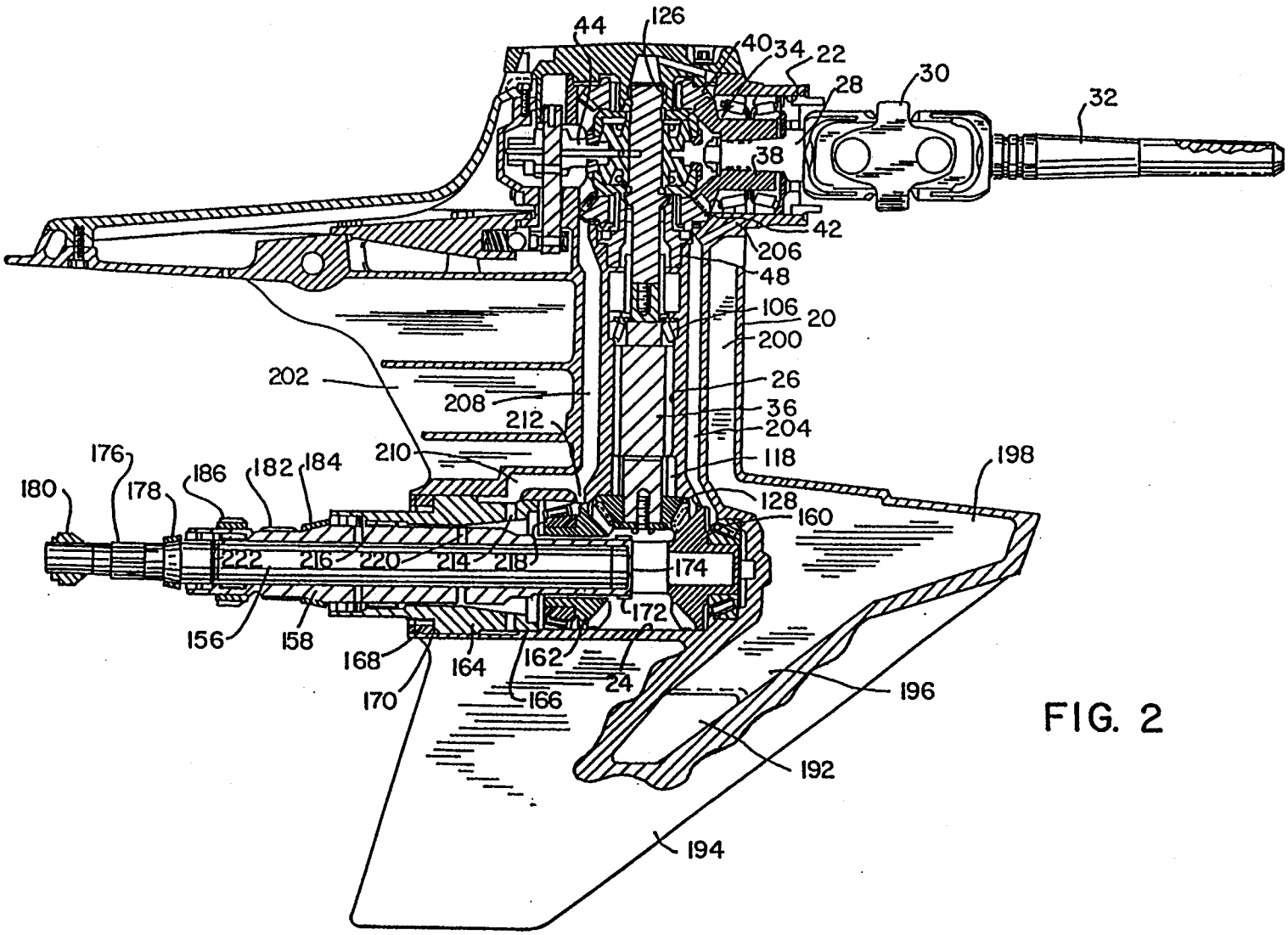
FIG. 2 is a partial sectional view of a portion of the structure of FIG. 1.

A pair of lower concentric counter-rotating inner and outer propeller shafts 156 and 158, FIG. 2, in lower horizontal bore 24 are driven by driveshaft 36. Inner propeller shaft 156 has a fore gear 160 driven by pinion gear 128 to drivingly rotate inner propeller shaft 156. Outer propeller shaft 158 has an aft gear 162 driven by pinion gear 128 to drivingly rotate outer propeller shaft 158 in the opposite rotational direction than inner propeller shaft 156. Reference is made to allowed incorporated U.S. application Ser. No. 07/889,530, filed May 27, 1992. The dual propeller shaft assembly is mounted in horizontal bore 24 by a spool assembly 164 at right hand threads 166 and retaining ring 168 having left hand threads 170. The right hand threads prevent right hand rotational loosening of the spool assembly, and the left hand threads 170 prevent left hand rotational loosening of the spool assembly. Forward thrust is transferred from the outer propeller shaft 158 to the inner propeller shaft 156 at thrust bearing 172 against annular shoulder 174 on inner propeller shaft 156. Propeller 12 is mounted on inner propeller shaft 156 in splined relation at 176 between tapered ring 178 and threaded nut 180. Propeller 14 is mounted on outer propeller shaft 158 in splined relation at 182 between tapered ring 184 and threaded nut 186.

The vertical distance between adaptor spool 48 and lower bearing 118 is about equal to the radius of propellers 12 and 14. Lower horizontal bore 24 of housing 20 is in the portion commonly called the torpedo 188, FIGS. 1 and 4. Torpedo 188 is slightly above the bottom 190 of boat 18 and hence is slightly above the surface of the water, thus reducing drag. This raising of the torpedo above the surface of the water is accomplished without a like raising of the engine in the boat nor the usual transom mounting location for the drive. In the preferred embodiment, the engine is raised 2 to 3 inches above its standard location. Housing 20 is a one-piece unitary integrally cast housing replacing prior two piece housings. Propeller shafts 156, 158 are spaced from upper input shaft 28 by a distance along driveshaft 36 in the range of about 8 to 15 inches.

Cooling water for the engine is supplied through water intake 192 in skeg 194, and flows through skeg passage 196 and then through torpedo nose passage 198 and then through housing passage 200 to the engine in the usual manner. After cooling the engine, the water and engine exhaust are exhausted in the usual manner through an exhaust elbow and exhausted through the housing and discharged at exhaust outlet 202 above torpedo 188 and into the path of the propellers in the upper portion of their rotation, as in U.S. Pat. No. 4,871,334. Oil is circulated from the lower gears upwardly through passage 204 and passage 206 to the upper gears, and returned to the lower gears at passage 208 feeding passages 210 and 212. Oil is supplied from passage 210 through spool assembly passage 214 to bearings 216 and 218, and through outer propeller shaft passage 220 to bearing 222. Passage 212 supplies oil to the front of bearing 218. Central outer section 64 of adaptor spool 48 closes off oil passage 204, to divert flow to passage 206.

Figure 4:
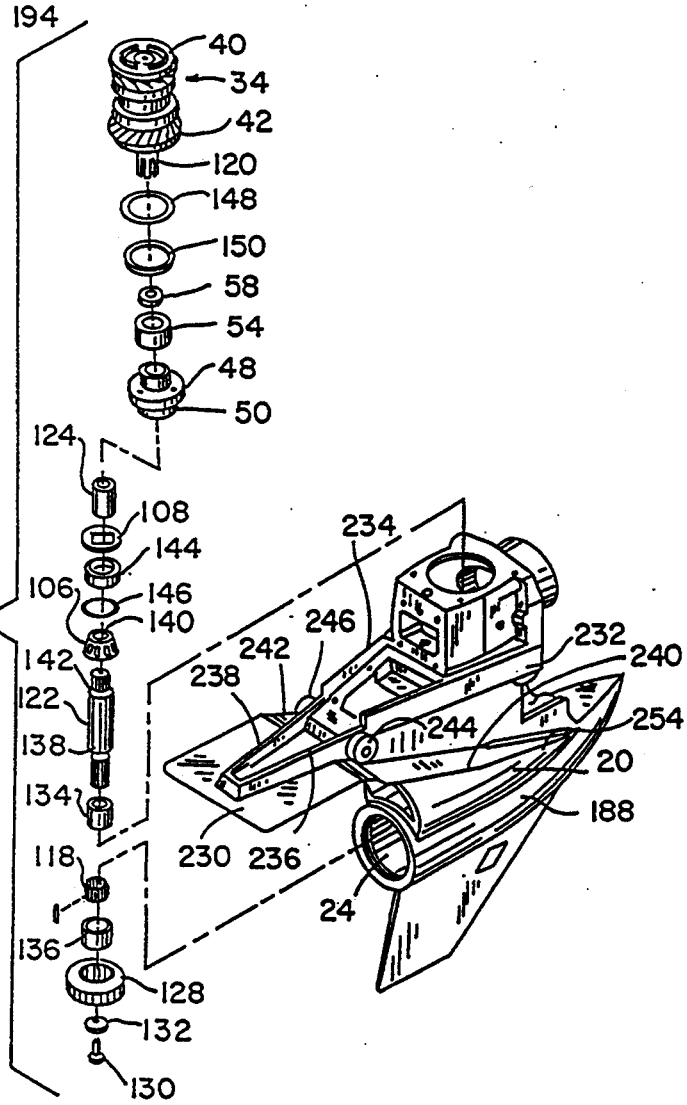
FIG. 4 is an exploded perspective view of a portion of the structure of FIG. 1.

Planing plate 230, FIGS. 1 and 4, extends rearwardly from housing 20 above propellers 12 and 14 and pushes down on the surface of the water during initial boat acceleration to in turn lower the bow and aid in getting the boat up on plane. Planing plate 230 is substantially horizontally aligned with upper adaptor spool 48. Housing 20 has right and left sides 232 and 234 with integral rearward extensions 236 and 238 extending rearwardly along the top of planing plate 230. Extensions 236 and 238 taper toward each other as they extend rearwardly and provide an integral V-shape support rib extending integrally rearwardly from housing 20. Planing plate 230 is a flat rectangular member extending rearwardly beyond rearmost propeller 12 and integral with V-shape support rib 236, 238 along the underside of the latter.

Right and left inclined splash plates 240 and 242 along right and left sides 232 and 234 of the housing extend from torpedo portion 188 rearwardly and upwardly at an incline, and extend beneath and rearwardly past trim cylinder mounting trunions 244 and 246, and meet planing plate 230. Right and left splash plates 240 and 242 and planing plate 230 block spray and splash when the boat is running on plane, i.e. when torpedo portion 188 is partially or totally out of the water. Right and left splash plates 240 and 242 are integral with housing 20 and integrally merge with planing plate 230. The incline of right and left splash plates 240 and 242 continues rearwardly beyond a vertical line 248 through the aft end of torpedo portion 188. The incline of right and left splash plates 240 and 242 crosses vertical line 248 at a point 250 spaced from propeller shafts 156 and 158 by a distance substantially equal to propeller radius. Right and left splash plates 240 and 242 extend rearwardly beyond vertical line 248 and have trailing ends merging with planing plate 230 at a point 252 spaced upwardly and rearwardly of point 250. Right and left splash plates 240 and 242 have forward leading ends at torpedo portion 188, as shown at forward leading end 254 of right splash plate 240. The forward leading ends of splash plates 240 and 242 are forward of vertical bore 26.

Figure 5:
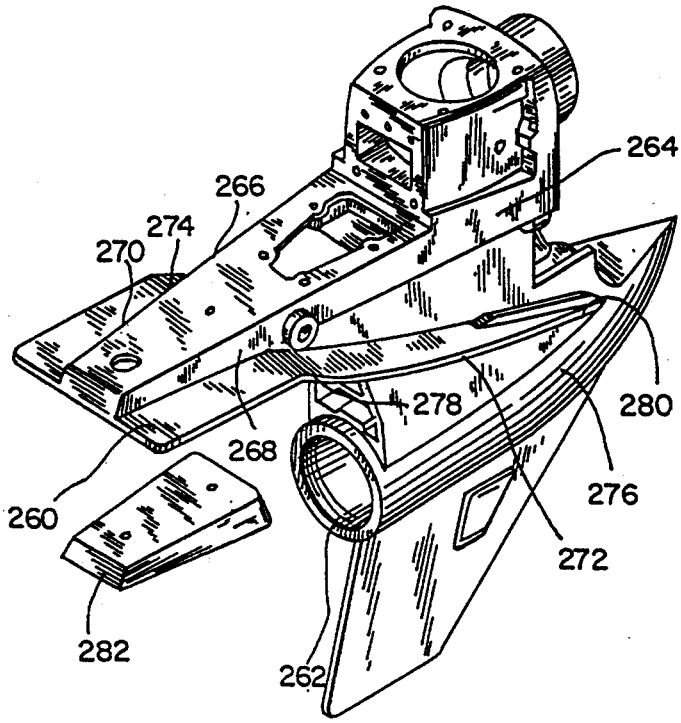
FIG. 5 is like FIG. 1 but shows a trimmed-in condition.

FIG. 5 shows a further embodiment wherein planing plate 260 extends rearwardly from housing 262 above the propeller and pushes down on the surface of the water during initial boat acceleration to in turn lower the bow and aid in getting the boat up on plane. Planing plate 260 is substantially horizontally aligned with upper adaptor spool 48. Housing 262 has right and left sides 264 and 266 with integral rearward extensions 268 and 270 extending rearwardly along the top of planing plate 260. Extensions 268 and 270 taper toward each other as they extend rearwardly and provide an integral V-shape support rib extending integrally rearwardly from housing 262. Planing plate 260 is a flat rectangular member extending rearwardly beyond the rearmost propeller and integral with V-shape support rib 268, 270 along the underside of the latter.

Right and left inclined splash plates 272 and 274 along right and left sides 264 and 266 of the housing extend from torpedo portion 276 rearwardly and upwardly at an incline and meet planing plate 260. Right and left splash plates 272 and 274 and planing plate 260 block spray and splash when the boat is running on plane, i.e. when torpedo portion 276 is partially or totally out of the water. Right and left splash plates 272 and 274 are integral with housing 262 and integrally merge with planing plate 260. The incline of right and left splash plates 272 and 274 continues rearwardly beyond the noted vertical line 248, FIG. 1, through the aft end of the torpedo portion. The incline of right and left splash plates 272 and 274 crosses vertical line 248 at the noted point 250, FIG. 1, spaced from propeller shafts 156 and 158 by a distance substantially equal to propeller radius. Right and left splash plates 272 and 274 extend rearwardly beyond vertical line 248 and have trailing ends merging with planing plate 260 at a point 278 spaced upwardly and rearwardly of the noted point 250. Right and left splash plates 272 and 274 have forward leading ends at torpedo portion 276, as shown at forward leading end 280 of right splash plate 272. The forward leading ends of splash plates 272 and 274 are forward of vertical bore 26. Sides 268 and 270 define an upwardly extending cavity therebetween receiving sacrificial anode 282, wherein the underside of anode 282 is substantially flush with the underside of planing plate 260.

It is recognized that various equivalents, alternatives and modifications are possible within the scope of the appended claims.

We claim:

1. A marine drive for propelling a boat comprising:

a housing having upper and lower horizontal bores and an intersecting vertical bore extending therebetween;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

an upper gear in said housing and operatively connected between said input shaft and said driveshaft;

a lower gear in said housing and operatively connected between said driveshaft and said propeller shafts;

a lower bearing at the bottom of said vertical bore and supporting said driveshaft for rotation;

an upper adaptor spool at the top of said vertical bore and supporting said driveshaft for rotation;

a planing plate extending rearwardly from said housing above said propellers and substantially horizontally aligned with said upper adaptor spool.

2. A marine drive for propelling a boat comprising:

a housing having upper and lower horizontal bores and an intersecting vertical bore extending therebetween, said housing including a lower torpedo portion around said lower horizontal bore;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounting to a respective one of said propeller shafts;

a planing plate extending rearwardly from said housing above said propellers and pushing down on the surface of the water during initial boat acceleration to in turn lower the bow and aid in getting the boat up on plane;

right and left inclined splash plates along the sides of said housing and extending from said torpedo portion rearwardly and upwardly at an incline and meeting said planing plate, wherein said right and left splash plates and said planing plate block spray and splash when the boat is running on plane.

3. The invention according to claim 2 wherein said right and left splash plates and said planing plate are integral with said housing.

4. The invention according to claim 3 wherein said right and left splash plates integrally merge with said planing plate.

5. The invention according to claim 2 wherein the incline of said right and left splash plates continues rearwardly beyond a vertical line through the aft end of said torpedo portion.

6. The invention according to claim 2 wherein the incline of said right and left splash plates crosses a vertical line through the aft end of said torpedo portion at a point spaced from said propeller shafts by a distance substantially equal to propeller radius.

7. The invention according to claim 2 wherein said right and left splash plates extend rearwardly beyond a vertical line through the aft end of said torpedo portion and have trailing ends merging with said planing plate at a point spaced upwardly and rearwardly of the point of intersection of said vertical line and said splash plates.

8. The invention according to claim 2 wherein said right and left splash plates have forward leading ends at said torpedo portion.

9. The invention according to claim 8 wherein said leading ends are forward of said vertical bore.

* * * * *